US006792870B2

(12) United States Patent
Theurer et al.

(10) Patent No.: US 6,792,870 B2
(45) Date of Patent: Sep. 21, 2004

(54) MACHINE FOR REMOVING AN OLD TRACK AND LAYING A NEW TRACK

(75) Inventors: Josef Theurer, Vienna (AT); Manfred Brunninger, Altenberg (AT)

(73) Assignee: Franz Plasser Bahnbaumaschinen-Industriegellschaft m.b.H., Vienna (AU)

( * ) Notice: Subject to any disclaimer, the term of this patent is extended or adjusted under 35 U.S.C. 154(b) by 0 days.

(21) Appl. No.: 10/637,999

(22) Filed: Aug. 8, 2003

(65) Prior Publication Data

US 2004/0045472 A1 Mar. 11, 2004

(30) Foreign Application Priority Data

Sep. 5, 2002 (AT) ..... GM589/2002

(51) Int. Cl.[7] ..... E01B 29/00
(52) U.S. Cl. ..... 104/9; 104/2
(58) Field of Search ..... 104/2, 5, 9

(56) References Cited

U.S. PATENT DOCUMENTS 4,236,452 A * 12/1980 Theurer et al. ..... 104/2
4,867,068 A * 9/1989 Valditerra ..... 104/2
5,904,098 A * 5/1999 Theurer et al. ..... 104/2
2002/0005140 A1 * 1/2002 Theurer et al. ..... 104/9

FOREIGN PATENT DOCUMENTS

EP 1 179 635 A2 2/2002

* cited by examiner

*Primary Examiner*—Mark T. Le
(74) *Attorney, Agent, or Firm*—Collard & Roe, P.C.

(57) ABSTRACT

In a machine for removing an old track and laying a new track, which comprises a device for receiving old ties, a first conveyor device arranged adjacent thereto for conveying the old ties away from the device for receiving the old ties, and a second conveyor device for conveying new ties to a device for laying new ties, a transfer device having a power-driven, vertically adjustable transfer element for selectively transferring old ties from the first to the second conveyor device is arranged.

4 Claims, 1 Drawing Sheet

MACHINE FOR REMOVING AN OLD TRACK AND LAYING A NEW TRACK

BACKGROUND OF THE INVENTION

1. Field of the Invention

The present invention relates to improvements in a machine for removing an old track and laying a new track, which comprises a device for receiving old ties, a first conveyor device arranged adjacent thereto for conveying the old ties away from the device for receiving the old ties, and a second conveyor device for conveying new ties to a device for laying new ties. This invention also relates to an improved method.

2. Description of the Prior Art

Such machines are well known and exemplified in EP 1 179 635 A2. The machine comprises a machine frame movable along a track, which comprises two machine frame parts linked to each other, and devices for receiving old ties and laying new ties, as well as conveyors for removing the old ties and conveyor the new ties mounted on the machine frame.

SUMMARY OF THE INVENTION

It is the primary object of this invention to improve a machine of this type by enabling old ties in good condition to be reused in the new track in a simple and cost-effective manner.

This and other objects are accomplished according to one aspect of the invention in a machine of the above-described structure with a transfer device having a vertically adjustable transfer element for selectively transferring old ties from the first to the second conveyor device, and drive means for vertically adjusting the transfer element.

According to another aspect, in a continuous method for removing an old track and laying a new track, which comprises the steps of simultaneously removing old ties in one conveying direction and conveying new ties to a tie laying device in the opposite conveying direction, the present invention provides the step of selectively deflecting old ties being removed in the one conveying direction to being conveyed in the opposite conveying direction to the tie laying device.

With this improvement in the machine and method, it is possible to reuse old ties that are still in good condition in a very economical manner. It is no longer required to convey all the old ties to freight cars and to store them on the cars, where they may be sorted in a time-consuming and labor-intensive manner, with reusable old ties being stored separately and then conveyed back to the track renewal site. Rather, these reusable old ties can now be relayed directly at the renewal site together with the new ties, at a minimal machine construction cost. The old ties which cannot be reused are conveyed away and stored, as before.

BRIEF DESCRIPTION OF THE DRAWING

The above and other objects, features and advantages of this invention will now be described in more detail with reference to the accompanying drawing, in which.

DETAILED DESCRIPTION OF THE PREFERRED EMBODIMENTS

Figures 1, 2, 3:
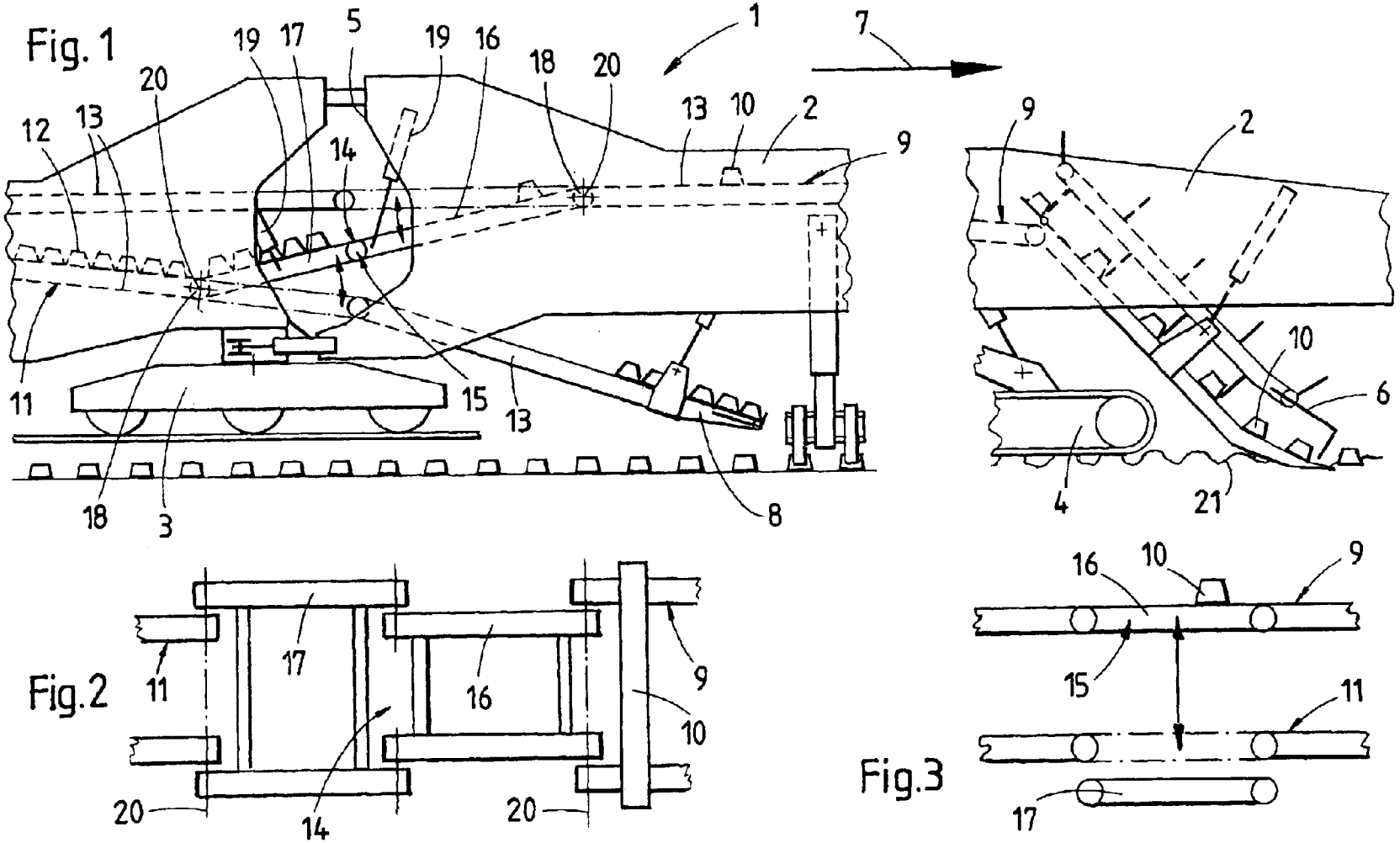
FIG. 1 is a side elevational view of that portion of a machine for removing an old track and laying a new track, which contains the structures for removing the old ties and laying the new ties.
FIG. 2 is a simplified top view of one embodiment of the transfer device.
FIG. 3 is a simplified side view of another embodiment of the transfer device.

Referring to FIG. 1, illustrated machine 1 for removing an old track and laying a new track comprises essentially machine frame 2 supported on undercarriages 3 for movement along the old track and the new track, as well as full-track carriage 4 supporting the machine frame on ballast bed 21 at the track renewal site where there is no track. In view of the length of machine frame 2, it is divided into two machine frame parts which are linked together at 5. A device 6 for receiving old ties 10 is mounted on the machine frame, a first conveyor device 9 is arranged adjacent thereto for conveying old ties 10 away from device 6 for receiving the old ties, and a second conveyor device 11 is also mounted on the machine frame for conveying new ties 12 to a device 8 for laying new ties, which is arranged rearwardly of device 6 in an operating direction indicated by arrow 7. Each conveyor device 9, 11 is comprised of a plurality of conveyor bands 13 extending in the operating direction along a longitudinal extension of machine 1. All of this structure is known in track renewal machines.

According to the present invention, a transfer device 14 having a vertically adjustable transfer element 15 is provided for selectively transferring old ties 10 from the first conveyor device 9 to the second conveyor device 11, and drive means 19 vertically adjust the transfer element 15. The illustrated transfer element is a transfer conveyor section 16, 17 of each conveyor device, and the drive means comprises a respective drive 19 pivoting a respective one of the transfer conveyor sections about a transversely extending horizontal axis 20 between a normal conveying position (shown in phantom lines), in which the transfer conveyor sections form a part of their conveyor devices, and a transfer position (shown in full lines), in which they transfer old ties from the first to the second conveyor device. A rotary drive 18 selectively moves transfer conveyor sections 16, 17 in opposite conveying directions.

FIG. 3 shows an embodiment of transfer device 14 which has only one transfer element 15, i.e. transfer conveyor section 16 of first conveyor device 9. As indicated by the double-headed arrow, transfer conveyor section 16 is vertically adjusted into the transfer position indicated in phantom lines, where it becomes a section of second conveyor device 11, transfer conveyor section 17 having been lowered to make room for transfer conveyor section 16.

The operation of machine 1 described hereinabove will now be briefly described:

In a continuous method for removing an old track and laying a new track, old ties 10 are removed from ballast bed 21 by tie receiving device 6 and are conveyed by conveyor device 9 away from the tie receiving device in one conveying direction opposite to the operating direction indicated by arrow 9 and, simultaneously, new ties 12 are conveyed by conveyor device 11 to tie laying device 8 in the opposite conveying direction. The tie laying device lays the new ties on the ballast bed, which has been smoothed. All of these steps are well known.

During this conventional procedure, transfer conveyor sections 16, 17 are in their normal position indicated in phantom lines, in which they simply form a part of first and second conveyor devices 9, 11. However, according to this invention, when a group of reusable old ties 10 is received and conveyed on transfer conveyor section 16 of first conveyor device 9, drives 9 are actuated to reposition transfer conveyor sections 16, 17 into their transfer position indicated in full lines to form the transfer bridge shown in FIG. 2, and rotary drive 18 of transfer conveyor section 17 is reversed in a conveying direction opposite to the operating direction indicated by arrow 9 so that no further new ties 12 are conveyed to tie laying device 8.

As soon as the group of reusable old ties 10 has reached transfer conveyor section 17, it is pivoted back into its normal position and rotary drive 18 is actuated to reverse its conveying direction back into the operating direction. In this way, reusable old ties 10 being removed in the conveying direction opposite to the operating direction are selectively deflected to being conveyed in a conveying direction in the operating direction to tie laying device 8. The reusable old ties are laid on smoothed ballast bed 21.

This procedure may be repeated every time a group of reusable old ties is encountered during the track renewal operation, while the transfer conveyor sections are maintained in their normal position for removal of the old ties if these ties are not reusable.

What is claimed is:

1. In a machine for removing an old track and laying a new track, which comprises a device for receiving old ties, a first conveyor device arranged adjacent thereto and extending along a first path for conveying the old ties away from the device for receiving the old ties, and a second conveyor device extending along a separate second path for conveying new ties to a device for laying new ties:

(a) a transfer device having a vertically adjustable transfer element to selectively connect the first and second paths for transferring old ties from the first to the second conveyor device, or selectively disconnect the first and second paths so that old and new ties would travel in separate paths, and (b) drive means for vertically adjusting the transfer element.

2. In the machine of claim 1, the transfer element is a transfer conveyor section of each conveyor device, and the drive means comprises a respective drive pivoting a respective one of the transfer conveyor sections about a transversely extending horizontal axis between a normal conveying position and a transfer position.

3. In the machine of claim 2, a rotary drive for selectively moving each transfer conveyor section in opposite conveying directions.

4. In a continuous method for removing an old track and laying a new track, which comprises the steps of simultaneously removing old ties in one conveying path and conveying new ties to a tie laying device in a separate second conveying path: the step of selectively deflecting old ties being removed in the one conveying path to being conveyed in the second conveying path to the tie laying device.

* * * * *

UNITED STATES PATENT AND TRADEMARK OFFICE

CERTIFICATE OF CORRECTION

PATENT NO. : 6,792,870 B2
DATED : September 21, 2004
INVENTOR(S) : Theurer-Brunninger It is certified that error appears in the above-identified patent and that said Letters Patent is hereby corrected as shown below:

Title page,
Item [73], Assignee, please change "Vienna (AU)" to correctly read -- Vienna (AT) --.

Signed and Sealed this

Thirtieth Day of November, 2004

JON W. DUDAS
*Director of the United States Patent and Trademark Office*